US005520854A

United States Patent [19]

Porco et al.

[11] Patent Number: 5,520,854

[45] Date of Patent: May 28, 1996

[54] APPARATUS AND METHOD FOR PREVENTING THE ACCUMULATION OF BACTERIA IN A HUMIDIFIER

[75] Inventors: Richard Porco, Cincinnati; Michael Doersam, Amelia, both of Ohio

[73] Assignee: Ellis & Watts, Division of Dynamics Corporation of America, Batavia, Ohio

[21] Appl. No.: 377,955

[22] Filed: Jan. 25, 1995

[51] Int. Cl.[6] ..... B01F 3/04

[52] U.S. Cl. ..... 261/5; 261/72.1; 261/81; 261/DIG. 46; 261/DIG. 48

[58] Field of Search ..... 261/DIG. 46, DIG. 48, 261/5, 6, 81, 72.1

[56] References Cited

U.S. PATENT DOCUMENTS

| | | | |
|---|---|---|---|
| 3,952,181 | 4/1976 | Reed | 219/272 |
| 4,257,989 | 3/1981 | Nishikawa | 261/4 |
| 4,355,636 | 10/1982 | Oetjen et al. | 128/204.13 |
| 4,361,522 | 11/1982 | Goettl | 261/DIG. 46 |
| 4,588,425 | 5/1986 | Ursy et al. | 55/227 |
| 4,663,091 | 5/1987 | Seo | 261/72.1 |
| 5,145,585 | 9/1992 | Coke | 261/DIG. 46 |

FOREIGN PATENT DOCUMENTS

| | | | |
|---|---|---|---|
| 0282740 | 12/1986 | Japan | 261/DIG. 46 |
| 4-80542 | 3/1992 | Japan | 261/DIG. 46 |
| 6-88634 | 3/1994 | Japan | 261/DIG. 48 |

*Primary Examiner*—Tim R. Miles
*Attorney, Agent, or Firm*—McCormick, Paulding & Huber

[57] ABSTRACT

Apparatus and method for inhibiting the accumulation of bacteria within a humidifier includes a primary water path for directing water directly from a water source to a humidifier during its operation. When the humidifier is shut-down for a cleaning operation, water is directed through a bacteria-removing device before entering the humidifier. Water contact surfaces within the humidifier are preferably lined with copper to further inhibit bacterial growth.

20 Claims, 3 Drawing Sheets

APPARATUS AND METHOD FOR PREVENTING THE ACCUMULATION OF BACTERIA IN A HUMIDIFIER

FIELD OF THE INVENTION

The present invention relates to method apparatus for maintaining a clean water vapor emission from a humidifier, and more particularly, to method apparatus for preventing the accumulation of bacteria in a humidifier.

BACKGROUND INFORMATION

Humidifiers are employed routinely in buildings, homes and the like to add moisture to the surrounding air, particularly during the winter months. The water vapor is generated by methods such as heating water in passage through a heater coil and by vibrating transducer coils to cavitate water into a vapor. Unfortunately, mineral deposits within the supplied water, and bacteria in both the water and surrounding air accumulate within the humidifier. As a result, the operational efficiency of the humidifier is impaired, and more importantly, bacteria emitted in the water vapor can pose a significant health threat to people breathing the humidified air.

De-ionized water has been successfully used to inhibit the accumulation of mineral deposits in humidifiers. However, no single solution is currently favored to retard bacteria accumulation within humidifiers. One approach is disclosed in U.S. Pat. No. 3,952,181 wherein a heating coil is dedicated to raising the supply water temperature sufficiently high to kill bacteria before the water is vaporized by a separate water receiving/steam generating coil. One drawback with this solution is that energizing the additional coil adds significantly to the power consumption and operating costs of the humidifier. Furthermore, such a solution is inapplicable to ultrasonic humidifiers which produce water vapor through a non-heating approach.

Another approach is disclosed in U.S. Pat. No. 4,663,091 wherein positive and negative electrical terminals are separated from one another in porously-separated internal cavities. The application of electric current to the terminals results in the sterilization of the water within the humidifier. Unfortunately, the humidifier requires additional parts and valves within its housing which increases the chances of humidifier malfunction. During malfunction, the humidifier must of course be taken off-line either to be repaired or replaced. In addition, the current necessary to maintain electrolysis of the water adds significantly to the operating costs of the humidifier.

It is an object of the present invention to overcome the drawbacks and disadvantages of prior apparatus and methods for inhibiting the accumulation of bacteria within a humidifier.

SUMMARY OF THE INVENTION

The present invention is directed to an apparatus and method for inhibiting the accumulation of bacteria within a humidifier. A primary water path having an inlet communicating with a pressurized water source, and an outlet communicating with an inlet of a humidifier supplies water, preferably de-ionized, to the water reservoir of a humidifier when the humidifier is in operation. A secondary water path having an inlet communicating with the inlet of the water source, and an outlet communicating with the inlet of the humidifier also supplies water to the humidifier but through a bacteria-removing device, preferably a bacteriostatic cartridge, during a cleaning cycle when the humidifier is not operating. Means for directing a flow of water along the primary water path and for preventing water from flowing along the secondary water path during humidifier operation preferably comprises one or more solenoid valves which may be magnetically actuated by means such as an electronic controller. Said means also directs a flow of water along the secondary water path through the bacteria-removing device and prevents water from flowing along the primary water path during the cleaning cycle when the humidifier is not in operation. The bacteria-removing device preferably treats the water with an iodine flush to inhibit the accumulation of bacteria within the humidifier. However, other bacteria-killing reagents may be substituted such as: chlorine, bromine and sodium bisulfate.

The surface of the humidifier's water reservoir is preferably copper-lined as opposed to conventional stainless steel to still better inhibit the accumulation of bacteria.

A time period as brief as fifteen to twenty-five minutes for the cleaning cycle has been found to adequately remove any accumulated bacteria.

A time period as long as about twenty-four to forty-eight hours for the operating cycle has been found acceptable without unacceptable accumulation of bacteria within the humidifier between cleaning cycles.

One advantage of the present invention is that the bacteria-removing device can be replaced during operation of the humidifier thus eliminating down-time.

Another advantage is that bacteria does not tend to grow on the surface of the copper-lined reservoir, thereby further inhibiting the accumulation of bacteria within such a humidifier as compared to conventional stainless steel humidifiers. The copper lining thus extends the duration between cleaning cycles.

Other advantages of the present invention will become apparent from the following detailed description and accompanying drawings.

DETAILED DESCRIPTION OF THE PREFERRED EMBODIMENT

Figure 1:
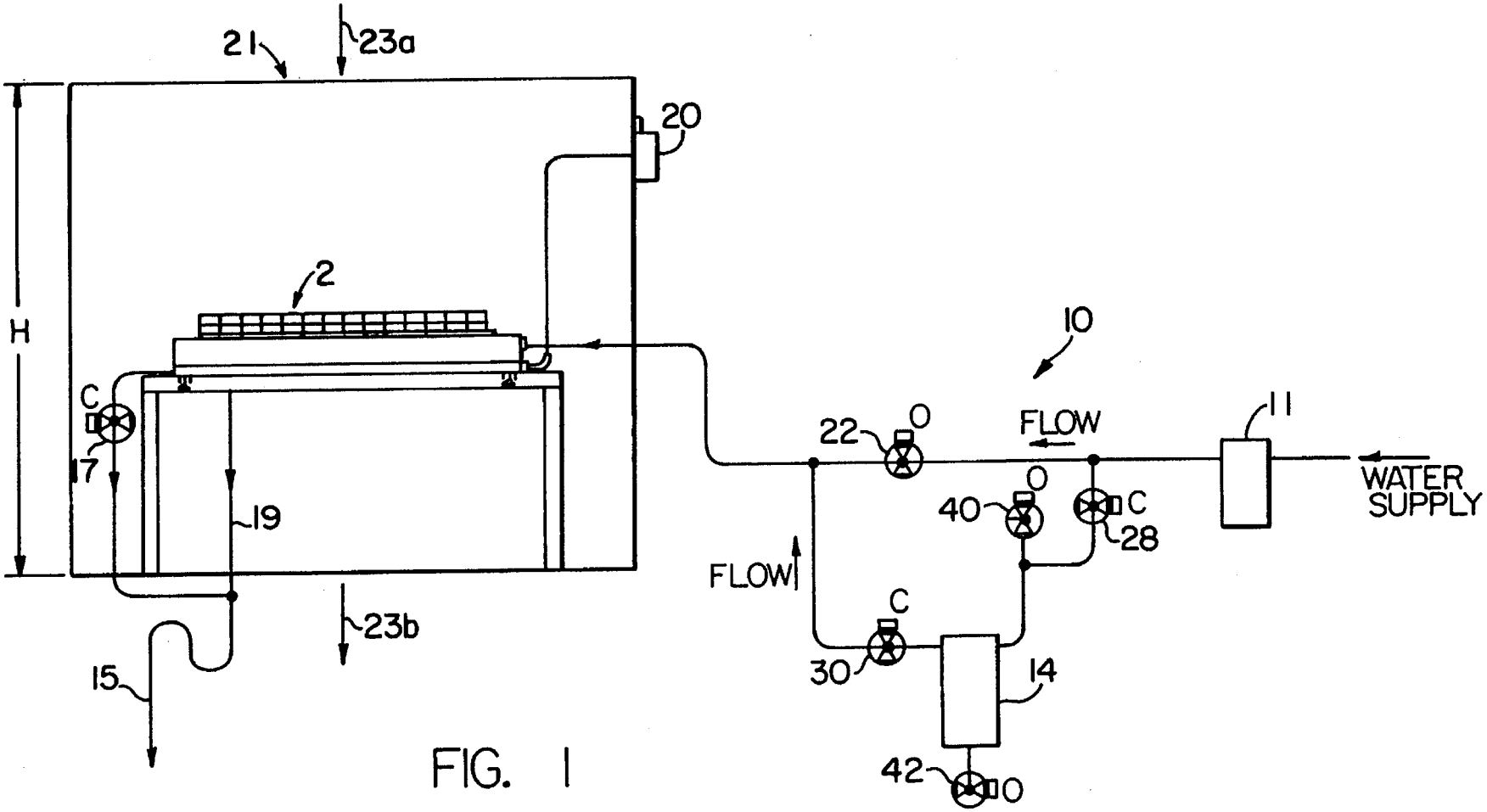
FIG. 1 is a schematic view of an apparatus in a first embodiment of the present invention for preventing the accumulation of bacteria in a humidifier.

In FIG. 1, apparatus schematically representing a first embodiment of the present invention for inhibiting the accumulation of bacteria in a humidifier is indicated generally by the reference numeral 2.

Water, preferably de-ionized, is typically pretreated through a standard water filter 11 to increase the energy efficiency of the humidifier operation and to prevent mineral build-up therewithin.

Apparatus 10 removes bacteria from a water reservoir (not shown) by directing the water originating from a pressurized water supply through a bacteria-removing device or member, preferably a bacteriostatic cartridge 14, containing bacteria-killing reagents, when the humidifier is shut-down during a cleaning cycle. The treated water is directed through the humidifier to flush or remove therefrom essentially all the bacteria which has accumulated within the humidifier and particularly it reservoir since a previous cleaning cycle. The water used to remove the bacteria then leaves the humidifier through a main drain 15 via a humidifier drain valve 17 which is open during flushing.

When the humidifier is placed back into operation after a cleaning cycle, the apparatus 10 redirects the flow of water so as to bypass the cartridge, thereby preventing bacteria-killing reagents from escaping into the atmosphere with the water vapor. The humidifier drain valve 17 is closed during humidifier operation to prevent water from escaping through the main drain. However, a condensate drain 19 permits condensed vapor to drain.

Tests have been conducted in which colonies of various bacteria have been permitted to grow on contact surfaces within the humidifier. Such bacteria include: *E. coli, P. vulgaris, S. aureus, S. typhimurium, P. aeruginosa* and *B. sphericus*. A five minute cleaning cycle using an iodine flush with a concentration between 0.1–0.3 parts per million (ppm) has proven effective in removing almost 100% of the bacteria from the contact surfaces.

The concentration of bacteria-.killing reagents within the water used to clean the humidifier is chosen to be high enough to kill bacteria, yet low enough to be within limits established by the Environmental Protection Agency (EPA) so as to allow the spent solution to be discharged directly into municipal drains.

As can be seen in FIG. 1, the humidifier may be placed within an air duct 21 with air flowing vertically downwardly as indicated by arrows 23*a,b*. As will be apparent, the humidifier may also be placed within an air conditioner, an air handler or may be a stand-alone unit.

Figure 2:
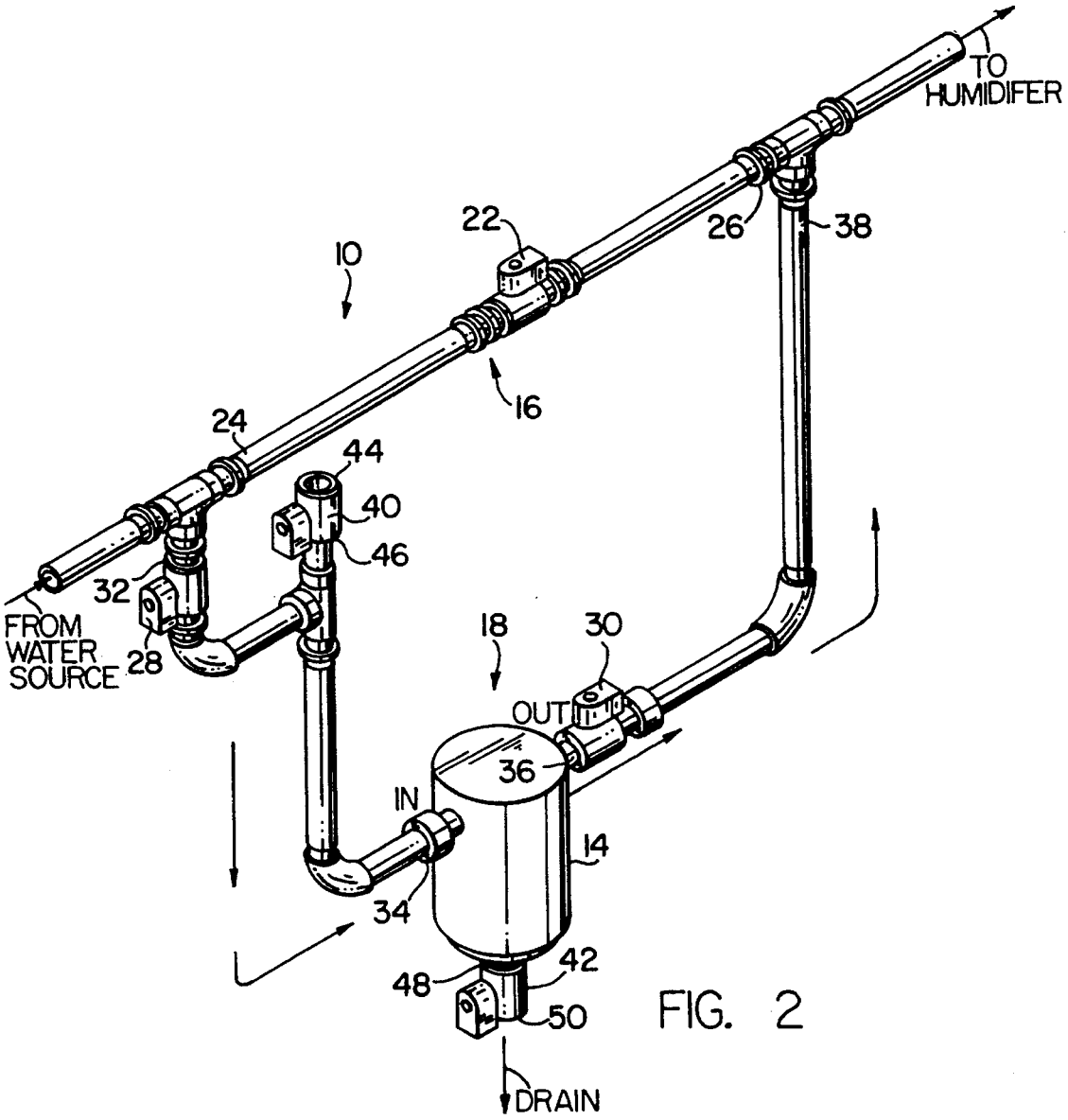
FIG. 2 is a perspective view of the apparatus of FIG. 1.

Referring now to FIG. 2 which is a perspective view of the apparatus 10 in a preferred embodiment, the structure and operation of the apparatus will be explained in greater detail. The apparatus 10 comprises a primary water path and a secondary water path denoted generally by respective reference numerals 16 and 18. The paths are preferably conduits such as pipes or the like. The primary water path allows water originating from a pressurized water supply to bypass bacteriostatic cartridge 14 and to flow directly into the humidifier when the humidifier is in an operating cycle. The secondary water path allows water originating from the pressurized water supply to first flow through the bacteriostatic cartridge 14 and then into the humidifier when the humidifier is shut-down during a cleaning cycle.

Means for directing the flow of water along either the primary or secondary water paths preferably comprise solenoid valves. The opening and closing of the solenoid valves may be controlled by suitable means, such as electronic controller 20, shown in FIG. 1. The electronic controller may be located either proximate or in a remote location relative to the humidifier.

As shown in FIGS. 1 and 2, three solenoid valves preferably direct the flow of water along either the primary or secondary paths depending on whether the humidifier is in an operating cycle or a cleaning cycle.

A first valve 22 for permitting a flow of water along the primary water path is interposed between an inlet 24 and an outlet 26 of the primary water path. Second and third valves 28 and 30 cooperate to direct a flow of water along the secondary water path. The second valve 28 is interposed between an inlet 32 of the secondary water path and an inlet 34 of the bacteriostatic cartridge 14. The third valve 30 is interposed between an outlet 36 of the bacteriostatic cartridge 14 and an outlet 38 of the secondary water path.

Preferably, the valves are predetermined to be normally-open or normally-closed so that the valves function in their normal state during the operating cycle. Accordingly the first valve 22 is chosen to be normally-open and the second and third valves 28,30 are chosen to be normally-closed. With the first valve open and the second and third valves closed during an operating cycle, water is permitted to flow along the primary water path before entering the humidifier and is prevented from flowing along the secondary water path and through the bacteriostatic cartridge. Hence, the flow of water during the operating cycle of the humidifier bypasses the bacteriostatic cartridge to prevent bacteria-killing reagents from escaping into the atmosphere with the water vapor.

Further, humidifier drain valve 17 is preferably normally-closed so as to be closed during the operating cycle, thereby preventing water supplied for vaporization from escaping into the main drain 15.

When the humidifier is shut-down during a cleaning cycle the controller 20 sends electrical signals to close the first valve 22 and to open the second and third valves 28 and 30 to prevent water from flowing along the primary water path and to accommodate water flow along the secondary path and through the bacteriostatic cartridge before entering the humidifier. Thus, the flow of water during the cleaning cycle is treated with bacteria-killing reagents to flush bacteria which has accumulated within the reservoir and other parts of the humidifier since the previous cleaning cycle. The controller 20 also opens the humidifier drain valve 17 to allow the spent water passing through the humidifier to exit into the main drain 15.

The apparatus 10 may also include fourth and fifth valves 40 and 42 actuated by the controller 20 for draining water from the bacteriostatic cartridge 14 when the humidifier is not in use during the operating cycle. The fourth and fifth valves 40,42 are normally-open to allow water to drain from the cartridge when not in use during normal humidifier operation. The fourth valve 40 is preferably positioned at a higher elevation with respect to the fifth valve 42 so that water can drain gravitationally from the fifth valve.

More specifically, the fourth valve 40 includes an inlet 44 and an outlet 46. The inlet 44 communicates with the surrounding atmosphere and is operationally positioned at a higher elevation with respect to the outlet 46. The outlet 46 communicates with the secondary water path between the inlet of the secondary water path 32 and the inlet 34 of the bacteriostatic cartridge 14.

The fifth valve 42 includes an inlet 48 and an outlet 50. The inlet 48 communicates with a bottom end of the cartridge 14. The outlet 50 communicates with the surrounding atmosphere and is positioned at a lower elevation with respect to the inlet 48. Thus, when the fourth and fifth valves are open, atmospheric pressure is equalized at the inlet of the fourth valve and the outlet of the fifth valve to allow water remaining in the cartridge from the previous cleaning cycle to drain by gravity from the outlet 50 of the valve 42.

Figure 3:
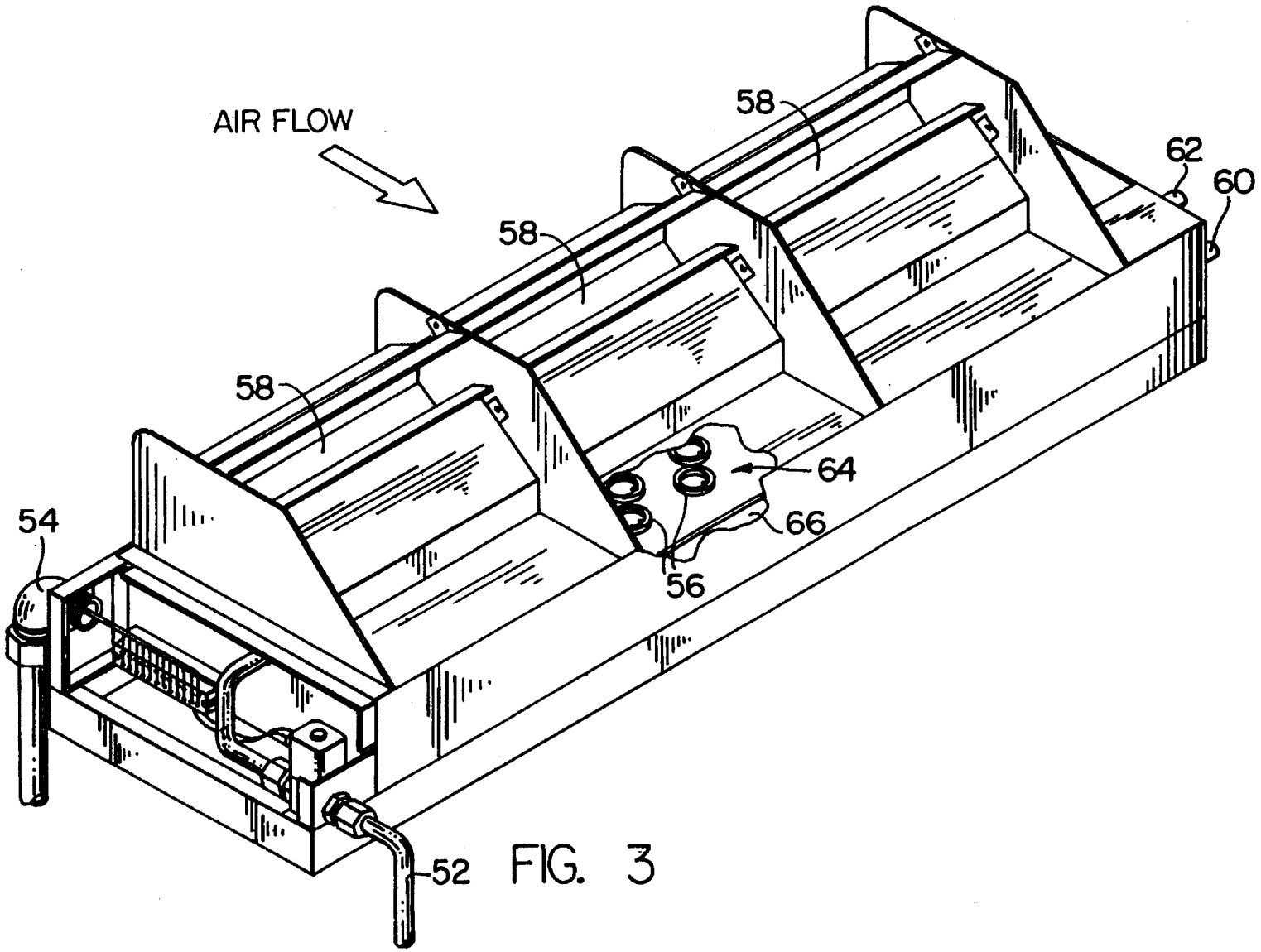
FIG. 3 is a perspective view of an ultrasonic humidifier including further apparatus for preventing the accumulation of bacteria.

FIG. 3 illustrates a perspective view of an ultrasonic humidifier containing an improvement to further inhibit the accumulation of bacteria within its water reservoir. The humidifier is shown with the exterior surface partly broken-away to show the interior of water reservoir therein. Water is fed into the humidifier via an inlet conduit 52. Electrical supply lines within an electrical supply conduit communicate with the humidifier at 54 to provide the necessary power to energize a plurality of ultrasonic transducers 56, 56 which, in turn, vibrate at a predetermined frequency to cavitate water within the reservoir to produce the water vapor that escapes into the atmosphere through one or more mist outlets 58, 58.

When the humidifier is in a cleaning cycle, water exits the humidifier via the main drain connector 60. Further, when the water within the reservoir rises beyond a certain level, excess water exits the humidifier via an overflow connector 62.

The improvement in the humidifier comprises a water reservoir referenced generally at 64 which contains a copper lining 66. Tests have shown that bacteria is substantially prevented from growing on the surface of copper, thereby offering a significant improvement over conventional stainless steel liners in inhibiting the accumulation of bacteria wit! bin the humidifier.

The copper lining may be used singly or in combination with a bacteria-killing reagent to inhibit the accumulation of bacteria within the humidifier.

As will be understood by those of ordinary skill in the pertinent art, numerous modifications may be made to the above-described and other embodiments of the present invention without departing from the scope of the appended claims. Accordingly, the preceding portion of this specification is to be taken in an illustrative, as opposed to a limiting sense.

We claim:

1. An apparatus for preventing the accumulation of bacteria in a humidifier, comprising:

means defining a primary water path having an inlet communicating with a pressurized water source, and an outlet communicating with an inlet of a humidifier, the primary water path supplying water to a water reservoir of the humidifier during operation;

means defining a secondary water path having an inlet communicating with the water source, and an outlet communicating with the inlet of the humidifier, the secondary water path supplying water to the humidifier during a cleaning cycle when the humidifier is not operating;

a bacteria-removing device interposed between the inlet and outlet of the secondary water path for removing bacteria from the water reservoir of the humidifier during the cleaning cycle; and means for directing a flow of water along the primary water path and preventing water from flowing along the secondary water path during humidifier operation, and for directing a flow of water along the secondary water path through the bacteria-removing device and preventing water from flowing along the primary water path during the cleaning cycle when the humidifier is not in operation.

2. An apparatus as defined in claim 1, wherein the means for directing comprises one or more valves.

3. An apparatus as defined in claim 2, wherein the one or more valves are operated by one or more solenoids.

4. An apparatus as defined in claim 2, wherein the directing means further includes means for automatically controlling the one or more valves.

5. An apparatus as defined in claim 2, wherein the one or more valves comprises:

a first valve interposed between the inlet and the outlet of the primary water path; and at least one secondary valve interposed between the inlet and the outlet of the secondary water path, during humidifier operation, the first valve being open and the secondary valve being closed to allow water to flow along the primary water path to the humidifier and to prevent water from flowing along the secondary water path and through the bacteria-removing device, and during a cleaning cycle when the humidifier is off, the first valve being closed and the secondary valve being open to allow water to flow along the secondary water path and through the bacteria-removing member, and to prevent water from flowing along the primary water path.

6. An apparatus as defined in claim 5, wherein the at least one secondary valve comprises:

a second valve interposed between the inlet of the secondary water path and an inlet of the bacteria-removing device; and a third valve interposed between an outlet of the bacteria-removing device and the outlet of the secondary water path.

7. An apparatus as defined in claim 5, wherein the one or more valves further comprises:

a fourth valve having an air inlet which is coupled to the secondary water path and interposed between the second valve and the bacteria-removing device, the air inlet of the fourth valve being at a higher elevation than the outlet of the fourth valve; and a fifth valve having an inlet coupled to the bottom of the bacteria-removing device and drain outlet, the outlet of the fifth valve being at a lower elevation than the inlet of the fifth valve, the fourth and fifth valves being open during humidifier operation to allow air to enter the inlet of the fourth valve and to allow water in the cartridge to flow out the drain outlet of the fifth valve, and the fourth and fifth valves being closed during a cleaning cycle to prevent water flowing through the bacteria-removing member from escaping.

8. An apparatus as defined in claim 1, wherein the bacteria-removing device is a bacteriostatic cartridge.

9. An apparatus as defined in claim 8, wherein the cartridge includes a bacteria-killing reagent selected from the group including: iodine, chlorine, bromine, and sodium bisulfate.

10. An apparatus as defined in claim 8, wherein the cartridge includes iodine as a bacteria-killing reagent.

11. An apparatus as defined in claim 1, further comprising a humidifier including an inlet communicating with the outlets of the primary and secondary water paths, the humidifier further including a water reservoir having a copper layer to inhibit the accumulation of bacteria within the reservoir.

12. An apparatus as defined in claim 11, wherein the copper layer is a copper lining throughout the reservoir.

13. An apparatus system as defined in claim 11, wherein water to be supplied to the humidifier is de-ionized to further prevent the accumulation of bacteria within the water reservoir of the humidifier.

14. An apparatus as defined in claim 11, further including one or more piezoelectric transducers in the water reservoir for producing water vapor when the transducers are electrically energized.

15. An apparatus as defined in claim 14, wherein the one or more piezoelectric transducers are of the ultrasonic type.

16. A humidifier system for preventing the accumulation of bacteria, comprising:

a humidifier having a water reservoir, the reservoir including a surface in contact with water flowing through the reservoir, the contact surface of the reservoir comprising a copper layer for inhibiting the accumulation of bacteria within the reservoir;

means defining a primary water path having an inlet communicating with a pressurized water source, and an outlet communicating with an inlet of the water reservoir of the humidifier for supplying water to the reservoir when the humidifier is in operation;

means defining a secondary water path having an inlet communicating with the inlet of the water source, and an outlet communicating with the inlet of the water reservoir of the humidifier for supplying water to the humidifier during a cleaning cycle when the humidifier is not in operation;

a bacteria-removing device interposed between the inlet and outlet of the secondary water path for removing bacteria from the water reservoir of the humidifier during the cleaning cycle; and means directing a flow of water along the primary water path and preventing water from flowing along the secondary water path during humidifier operation, and for directing a flow of water along the secondary path through the bacteria-removing device and for preventing water from flowing along the primary water path during the cleaning cycle when the humidifier is not in operation.

17. A method of preventing accumulation of bacteria in a humidifier comprising the following steps:

an operating step directing water to flow along a primary water path from a pressurized water source to a humidifier during a predetermined first period when the humidifier is in operation;

a cleaning step directing water to flow along a secondary water path and through a bacteria-removing device from a pressurized water source to the humidifier during a predetermined second period following the first period when the humidifier is not in operation and is in a cleaning cycle; and repeating the first and second steps.

18. A method as defined in claim 17, wherein the first step further includes draining water from the bacteria-removing device.

19. A method as defined in claim 17, wherein the operating step has a duration of about twenty-four to forty-eight hours.

20. A method as defined in claim 17, wherein the cleaning step has a duration of about fifteen to twenty-five minutes.

* * * * *